US005516746A

United States Patent [19]

Ito

[11] Patent Number: 5,516,746

[45] Date of Patent: May 14, 1996

[54] IMAGE-FORMING METHOD AND AN INK RIBBON AND A PRINTING SHEET USED FOR THE METHOD

[75] Inventor: Kengo Ito, Kanagawa, Japan

[73] Assignee: Sony Corporation, Tokyo, Japan

[21] Appl. No.: 420,624

[22] Filed: Apr. 12, 1995

Related U.S. Application Data

[63] Continuation of Ser. No. 171,205, Dec. 21, 1993, abandoned, which is a continuation of Ser. No. 858,650, Mar. 27, 1992, abandoned.

[30] Foreign Application Priority Data

Mar. 28, 1991 [JP] Japan ..... 3-08952

[51] Int. Cl.[6] ..... B41M 5/035

[52] U.S. Cl. ..... 503/227; 428/195; 428/331; 428/913; 428/914

[58] Field of Search ..... 503/201, 217, 503/227; 428/195, 331, 913, 914

[56] References Cited

FOREIGN PATENT DOCUMENTS

| | | | |
|---|---|---|---|
| 0178832 | 4/1986 | European Pat. Off. | 503/227 |
| 0273307 | 7/1988 | European Pat. Off. | 503/227 |
| 0395006 | 10/1990 | European Pat. Off. | 503/227 |
| 0405219 | 1/1991 | European Pat. Off. | 503/227 |
| 3602437 | 7/1986 | Germany | 503/207 |

OTHER PUBLICATIONS

Patent Abstracts of Japan, vol. 16, No. 34(m–1) (204), Jan. 28, 1992.

*Primary Examiner*—Pamela R. Schwartz
*Attorney, Agent, or Firm*—Hill, Steadman & Simpson

[57] ABSTRACT

A method for forming images by a thermal transfer process. The method comprises the steps of providing a printing sheet having an image-receiving layer on one side thereof, providing an ink ribbon having a dye layer comprising a hydrophilic cationic dye, contacting the ink ribbon with the image-receiving layer, and applying a thermal energy to the ink ribbon in an imagewise pattern to thermally transfer the dye from the ink ribbon to the image-receiving layer. The image-receiving layer comprises at least a layer compound which has ion exchangeability with the cationic dye, so that the dye image is fixed through the ion exchange. Since the dye is bonded to the layer compound through ion exchange, the dye is fixed comparable to that of silver salt photography. A thermal transfer system using the ink ribbon and the printing sheet is also described.

10 Claims, 3 Drawing Sheets

IMAGE-FORMING METHOD AND AN INK RIBBON AND A PRINTING SHEET USED FOR THE METHOD

This is a continuation of application Ser. No. 08/171,205, filed Dec. 21, 1993, now abandoned, which is a continuation of application Ser. No. 07/858,650, filed Mar. 27, 1992, now abandoned.

BACKGROUND OF THE INVENTION

The present invention relates to an image-forming method wherein dye images are formed on a printing sheet by a thermal transfer system. The present invention further relates to a thermal transfer system comprising, in combination, an ink ribbon and a printing sheet for conducting the image-forming method.

Efforts have been made to form images by a thermal transfer system, wherein images that are taken by electronic still cameras are printed out on printing sheets. Silver salt photographs are representative of this process.

In a thermal transfer system, an ink ribbon containing a dye is contacted with a printing sheet having an image-receiving layer thereon. The ink ribbon is heated, for example, by a thermal head, resulting in the dye in the ink ribbon to transfer onto the image-receiving layer of the printing sheet. A polyester resin is used as the image-receiving layer of the printing sheet, and the dye of the ink ribbon that is used is a disperse dye.

As disclosed in Japanese Laid-open Patent Application Nos. 1-259989 and 1-275096, various modifications have been made to the disperse dye that is used in the aforementioned system. However, once transferred to the image-receiving layer, the dye is attached to the layer only by interactions with the polymer of the image-receiving layer, for example, Van der Waals force, dipolar force, hydrogen bonds, and the like. Therefore, after formation of the images, if the dye is contacted with a resin or a solvent which has a greater affinity for the dye or, if a thermal energy is supplied to the extent sufficient to offset the interaction, migration or dissolution of the dye is induced, resulting in the images being blurred.

To overcome these disadvantages, image formation through chemical bonds has been proposed utilizing several methods as disclosed in Japanese Laid-open Patent Application Nos. 59-78893, 60-2398, 60-110494, 60-220785, 60-260381 and 60-260391.

In one method, a dye is used which has a group that is reactive with an epoxy group or isocyanate group, and an image-receiving layer which contains a compound having an epoxy or isocyanate group. In another method, a dye is used which has an acryloyl group or methacryloyl group, and an image-receiving layer which contains a compound having active hydrogen. In yet another method, a dye is used that is capable of forming a metal complex, and an image-receiving layer which contains a metal compound. Also proposed is a method wherein a dye is formed by sublimating a low molecular weight compound having an active methyl or methylene group for reaction with an aldehyde or nitroso compound in an image-receiving layer.

These methods that utilize the chemical bonds, however, have several disadvantages. First, the reactivities of the dyes and the image-receiving layers are so high that storage properties are not suitable. Further, the reaction is not completed within a short time, thus requiring an undesirably long time for the formation of images. It is also difficult to prepare dyes, and the types of usable dyes are limited. In addition, fixation is not always satisfactory.

SUMMARY OF THE INVENTION

The present invention provides an image-forming method comprising the steps of providing a printing sheet having an image-receiving layer on one side thereof, the image-receiving layer comprising at least a layer compound which has ion exchangeability with a cationic dye; providing an ink ribbon having a dye layer which comprises a hydrophilic cationic dye; contacting the ink ribbon with the image-receiving layer; and applying a thermal energy to the ink ribbon in an imagewise pattern to thermally transfer the dye from the ink ribbon to the image-receiving layer, whereby the dye is fixed through an ion exchange.

The present invention further provides a thermal transfer system for conducting the image-forming method discussed hereinabove. The thermal transfer system comprises, in combination, an ink ribbon and a printing sheet, the ink ribbon having a support and a dye layer formed on the support and comprising a hydrophilic cationic dye, whose counter ion is substituted with an organic anion, and the printing sheet having a support and an image-receiving layer formed on the support and comprising a resin binder and a layer compound whose cations are substituted with ions capable of ion exchange with the cationic dye.

The method for forming images by a thermal transfer system significantly improves the fixing properties of the dye images over those obtained with existing thermal transfer systems. This improvement is due to the dye being transferred to and fixed on the image-receiving layer of a printing sheet instantaneously, because the dye is ionically bonded with the image-receiving layer. More specifically, when cationic dyes are transferred in an imagewise pattern on layer compounds (clay minerals) whose exchangeable cations between crystal layers are substituted with quaternary ammonium ions, phosphonium ions or the like, the dye image is converted to an insoluble and infusible pigment image which is eventually strongly fixed.

Through ion exchange, good sensitivity for the thermal transfer is achieved. The dye is strongly fixed on the printing sheet without any problems with the dye migrating after the formation of the dye images. As such, the images can be fixed comparable to silver salt photographic images.

The thermal transfer system of the present invention makes use of general-purpose dyes and clay minerals which can be provided inexpensively. In addition, use of the clay minerals in an image-receiving layer of a printing sheet imparts a surface hardness to the layer, thereby enabling one to write on the layer.

In practicing the present invention, the fixing of the dye images is performed by the ionic bond between the cationic moiety of the dye and the anionic moiety on the surface of the layer compound (organic cation-clay complex) included in the image-receiving layer of the printing sheet as swollen in a non-aqueous medium. Accordingly, for the formation of the dye images, the ink ribbon containing the cationic dye should be used in combination with the printing sheet having the layer compound in the image-receiving layer.

In one embodiment of the present invention, the layer compound is a montmorillonite of the general formula $$(X,Y)_{2-3}Z_4O_{10}(OH)_2 \cdot mH_2O \cdot (W_{1/3})$$

wherein X=A1, FE(III), Mn(III) or Cr(III), Y=Mg, Fe(II), Mn(II), Ni or Zn, Z=Si or A1, W=K, Na or Ca, $H_2O$ is water between the layers, and n is an integer.

In another embodiment, the layer compound is a mica.

In another embodiment, the ions used for the substitution are organic cations selected from the group consisting of quaternary alkylammonium ions, alkylphosphonium ions, and arylphosphonium ions.

In a further embodiment, the layer compound comprises an amount of from 5 to 90 wt % of the image-receiving layer.

Additional features and advantages of the present invention are further described, and will be apparent from the detailed description from the presently preferred embodiments.

DETAILED DESCRIPTION OF THE PRESENTLY PREFERRED EMBODIMENTS

Figure 1:
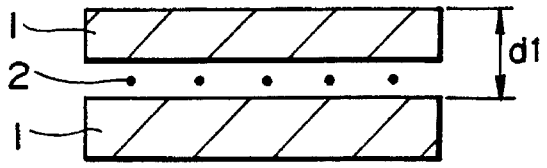
FIG. 1 is a schematic view of the structure of montmorillonite.

The present invention provides a method for forming images by a thermal transfer system. The image-forming method comprises the steps of: providing a printing sheet having an image-receiving layer on one side thereof, the image-receiving layer comprising at least a layer compound which has ion exchangeability with a cationic dye; providing an ink ribbon having a dye layer which comprises a hydrophilic cationic dye; contacting the ink ribbon with the image-receiving layer; and applying thermal energy to the ink ribbon in an imagewise pattern to thermally transfer the dye from the ink ribbon to the image-receiving layer, whereby the dye is fixed through the ion exchange.

The present invention further provides a thermal transfer system comprising, in combination, an ink ribbon and a printing sheet, the ink ribbon having a support and a dye layer formed on the support and comprising a hydrophilic cationic dye whose counter ion is substituted with an organic anion, and the printing sheet having a support and an image-receiving layer formed on the support and comprising a resin binder and a layer compound whose cations are substituted with ions capable of ion exchange with the cationic dye.

The layer compounds which are used in the printing sheet should have a layer structure and include clay minerals which have exchangeable cations between crystal layers. Typical examples include montmorillonoids. The montmorillonoids are clay minerals of the following general formula:

$$(X,Y)_{2\text{-}3}Z_4O_{10}(OH)_2.mH_2O.(W_{1/3})$$

wherein X=A1, Fe(III), MN(III) or Cr(III), Y=Mg, Fe(II), Mn(II), Ni or Zn, Z=Si or A1, W=K, Na or Ca, $H_2O$ is water between the layers, and m is an integer.

Depending on the combination of X and Y and the number of substitutions, there are a variety of naturally occurring montmorillonoids including montmorillonite, magnesian montmorillonite, iron montmorillonite, iron magnesian montmorillonite, beidellite, aluminian beidellite, nontronite, aluminian nontronite, saponite, aluminian saponite, hectorite, sauconite and the like. Aside from these natural products, there are commercially available products, wherein the OH groups of the formula described hereinabove are substituted with fluorine.

In the present invention, in addition to montmorillonoids, a mica group such as sodium silicic mica, sodium taeniolite, lithium taeniolite and the like may be used as the layer compounds. It should be noted that kaolinite, talc, pyrophyllite and the like, which have a layer structure but are free of any exchangeable cations inbetween the layers, are not suitable for use in the present invention. Zeolite, for example, has exchangeable cations such as alkali metal ions or alkaline earth metal ions. However, zeolite has a meshwork structure with a small pore size, which reduces its properties.

When used, the layer compounds are treated so that the cations of the compound in the layer structure are ionically exchanged with the organic cations. The preferred organic cations include quaternary alkylammonium ions and substituted phosphonium ions such as alkylphosphonium ions, arylphosphonium ions and the like. With quaternary ammonium ions, four alkyl moieties have a minimum of four carbon atoms, and preferably not less than eight carbon atoms. If the number of long-chain alkyl moieties is small, it is difficult to keep the distance between the layers at a desired level. As such, it is possible that satisfactory exchangeability with a dye will not be attained.

The organic cations function not only to extend the distance between the layers of layer compounds, but also to convert the inherently hydrophilic regions between the layers of the layer compound into hydrophobic regions due to the presence of the hydrophobic chains. Specifically, the organic cations function to make miscibility easier with the resin binders. The layer compounds, which have been ionically exchanged with organic cations such as the quaternary ammonium ions or substituted phosphonium ions, are imparted with ion exchangeability with cationic dyes and, at the same time, with swelling properties in non-aqueous solvents.

Once imparted with the ion exchangeability with cationic dyes and the swelling in non-aqueous solvents, the layer compound is dispersed by mixing it with resin binders in solvents, wherein the compound becomes swollen in the resin binder. In this condition, the mixture is applied to a film support and forms a film, thereby forming an image-receiving layer to obtain a printing sheet.

The film support may be paper sheets, synthetic paper sheets, plastic films, metallic sheets, metallic foils, plastic films deposited with aluminum or a similar metal, and the like.

The resin binders that are useful in the present invention include a wide variety of thermoplastic resins. However, those resins which have substituents that impede the fixing of the dye are not desirable. For example, an ammonium group is more susceptible to ion exchange inbetween the clay layers than cationic dyes.

The amount of the ion exchangeability-imparted layer compound should be preferably in the range of from 5 to 90 wt % of this image-receiving layer. The lower limit of this amount is determined with respect to the fixing properties. If the amount is less than 5 wt %, the fixing effect may be poor. On the other hand, the upper limit is determined on the basis of the film formation of the layer. When the amount exceeds 90 wt %, it becomes difficult to form a film which is soft with good properties.

The printing sheet should preferably have a high brightness. Although fluorescent brighteners such as synthetic mica may be added to the image-receiving layer, the layer compounds inherently have good brightness.

As long as the fixing properties are not impeded, plasticizers may be added to the image-receiving layer in order to appropriately control the glass transition point, Tg, of the resin binder. Additives may also be used for other purposes.

With respect to the ink ribbon, the dyes used in the ink ribbon are preferably cationic dyes. When the dyes do not have any cationic moiety, ion exchange with the organic cations of the layer compound is not possible, so that fixing through the formation of the ionic bond becomes impossible. The cationic dyes are water-soluble dyes having amine salts or quaternary ammonium groups and include azo dyes, triphenylmethane dyes, azine dyes, oxazine dyes, thiazine dyes and the like. Specific examples include C.I. Basic Yellow 1, 2, 11, 13, 14, 19, 21, 25, 28, 32, 33, 34, 35 or 36 (yellow dyes), C. I. Basic Red 1, 2, 9, 12, 13, 14, 15, 17, 18, 22, 23, 24, 27, 29, 32, 38, 39 or 40, C.I. Basic Violet 7, 10, 15, 21, 25, 26, 27 or 28 (magenta dyes), C.I. Basic Blue 1, 3, 5, 7, 9, 19, 21, 22, 24, 25, 26, 28, 29, 40, 41, 44, 45, 47, 54, 58, 59, 60, 64, 65, 66, 67 or 68 (cyan dyes), C. I. Basic Black 2 or 8 (black dyes), and the like.

The aforementioned cationic dyes are usually soluble in water. In practicing the invention, it is necessary for the dye to be quickly transferred to the image-receiving layer, wherein the layer compound is contained as swollen in the binder resin, so that the dye is subjected to hydrophobic treatment.

More particularly, a counter anion of the water-soluble cationic dyes is substituted with a hydrophobic organic anion to obtain a sparingly soluble or insoluble salt. This salt is dissolved or dispersed in a binder resin in a solvent, and then applied onto a film support to form an ink or dye layer. Thus, a thermal transfer ink ribbon is obtained. As a matter of course, the ink layer may be formed of the cationic dye alone, although this depends on the type of cationic dye that is used. Generally, if the amount of the cationic dye is too small, the color development density is insufficient for practical applications. The amount of the dye in the ink layer should preferably be in the range of from 10 to 100 wt %.

For the hydrophobic treatment of the cationic dye, it is sufficient to effect the ion exchange treatment of the dye with organic anionic surface active agents. Examples of the organic anionic surface active agents include but are not limited to the following: dodecylbenzenesulfonic acid, carboxylates such as soaps, salts of N-acylamino acid, alkyl ether carboxylates, carboxylates of acylated peptide, sulfonates such as alkylsulfonates, alkylbenzenesulfonates, alkylnaphthalenesulfonates, sulfosuccinates, α-olefinsulfonates, N-acylsulfonates, sulfuric esters such as sulfated oils, alkylsulfates, alkyl ether sulfates, alkyl allyl ether sulfates, alkylamido sulfates, and phosphoric esters such as alkylphosphates, alkyl ether phosphates, and alkyl allyl ether phosphates.

According to the image-forming method of the present invention, images are formed by providing the ink ribbon and the printing sheet set forth hereinabove, contacting the ink ribbon with the printing sheet, and selectively applying a thermal energy or stimulation, such as by a thermal head, to the ink ribbon according to image signals. The thermal energy or thermal stimulation means is not limited to the thermal head. Further, all thermal energy applying means, which have been previously set forth for use in the thermal transfer systems, may be used in carrying out the invention.

Montmorillonite, which is typical of the layer compounds used in the image-receiving layer of the printing sheet of the present invention, is described below with reference to the accompanying drawings in order to illustrate the principle of image formation according to the invention.

Montmorillonite has a layer structure which has recurring units of a three-layer structure having a fundamental regular octahedron skeleton. Layer water and alkali metal ions which are exchangeable cations are held inbetween the respective layers. This is particularly shown in FIG. 1. In the figure, non-treated montmorillonite 1 has exchangeable sodium ions 2 inbetween the layers. The distance between the layers is taken as d1 as shown.

Figure 2:
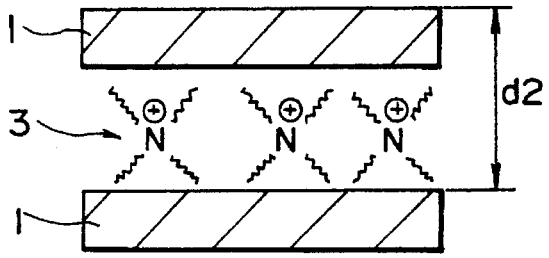
FIG. 2 is a schematic view of montmorillonite which is substituted with quaternary ammonium ions.

When the montmorillonite 1 is swollen with water to which quaternary ammonium ions 3 are added, ion exchange takes place as particularly shown in FIG. 2. The quaternary ammonium ions 3 are taken in instead of the sodium ions 2, which results in the distance, d2, between the layers being greater than the distance, d1, of the non-treated montmorillonite, thus imparting ion exchangeability with cationic dyes.

Since the ion exchangeability-imparted montmorillonite has the quaternary ammonium ions 3 having a hydrophobic chain retained inbetween the layers, it is dispersed as swollen in a non-aqueous binder resin system and is provided as the image-receiving layer of the printing sheet.

When the ink ribbon containing a hydrophobic cationic dye is contacted with or pressed against the image-receiving layer and applied with a thermal stimulation such as by a thermal head in an imagewise pattern, the hydrophobic cationic dye of the ink ribbon quickly migrates or transfers to the image-receiving layer, since the dye has undergone the hydrophobic treatment.

Figure 3:
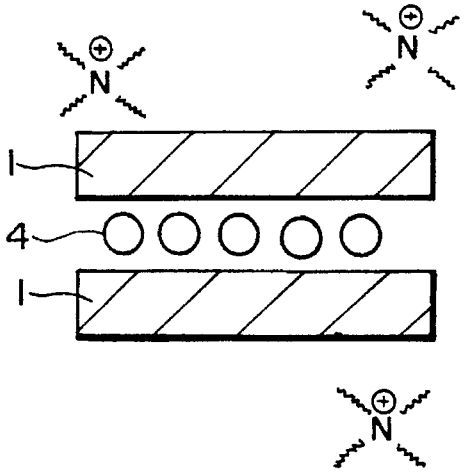
FIG. 3 is a schematic view of montmorillonite which is ionically exchanged with a cationic dye.

The transferred hydrophobic cationic dye is miscible with the non-aqueous image-receiving layer and enters into the respective layers of the montmorillonite filled with the hydrophobic resin binder. At this time, ion exchange between the quaternary ammonium ions 3 and the cationic dye occurs. Thus, the cationic dye molecules 4 are taken in the space between the layers of the montmorillonite 1 as shown in FIG. 3. The cationic dye molecules 4 taken in the space or region between the respective layers of the montmorillonite 1 form an ionic bond with the montmorillonite 1, resulting in the dye being strongly fixed in the image-receiving layer.

By way of example and not limitation, the following examples and drawings serve to further illustrate the present invention and its preferred embodiments.

EXAMPLE 1

A. Simulation of Fixing Behavior

A-1. Preparation of Organic Cation-Clay Complex 20 g of montmorillonite was dispersed and swollen in one liter of water, to which an equal amount of ethanol was added. While agitating, 13.2 g (20 mg equivalents) of tetra-n-decylammonium bromide dissolved in 200 cc of ethanol was dropped, whereupon granular coagulation or precipitation occurred.

The dispersion was allowed to stand for one week, and was followed by the collection of the precipitate by filtration and washing with a large amount of ethanol to remove unreacted quaternary ammonium salt therefrom.

Subsequently, the washed precipitate was dried at room temperature under reduced pressure to obtain a grayish white powder. The spacing of the powder at the (001) plane, which means a distance between the layers, was determined by powder X-ray diffraction analysis. The spacing of the powder was found to be 23.11 angstroms and increased by 13.3 angstroms over the spacing of the non-treated montmorillonite at 9.77 angstroms.

A-2. Fixing Operations in Non-Aqueous/High Dielectric Constant Medium 0.2 g of the quaternary ammonium-substituted montmorillonite obtained in A-1 was charged into 20 g of ethanol, which is a highly dielectric medium (specific dielectric constant of 24.55), and then subjected to ultrasonic irradiation for several minutes for swelling and dispersion.

To the dispersion was added 6 cc of an ethanol solution of 10 mmol/liter of Rhodamine 6 G of the following formula (cationic dye), whereupon a dark red precipitate was immediately formed with the supernatant liquid being substantially colorless (but emitting a slightly yellowish orange fluorescence). The formula is as follows:

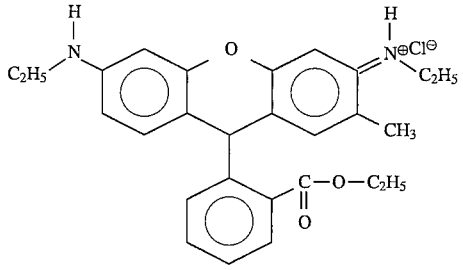

The colored precipitate was collected by filtration, washed with 100 cc of ethanol to completely remove the unreacted dye, and dried at room temperature.

The red powder obtained by the procedure described hereinabove had a spacing of 21.48 angstroms, which was smaller than the value of the quaternary ammonium-substituted montmorillonite.

Thereafter, 500 cc of a mixture of water and ethanol at a mixing ratio of 1:1 on the weight basis was added to the filtrate collected above, after which an aqueous perchlorate solution was dropped. As a result, a large amount of a white precipitate was settled.

The precipitate (collected in several tens milligrams) was identified as tetra-n-decylammonium perchlorate based on its melting point of from 105° C. to 110° C. and an IR spectrum analysis.

From the foregoing, it is apparent that the cationic dye in the ethanol was exchanged with the tetra-n-decylammonium ions substituted inbetween the layers of the montmorillonite.

Figure 4:
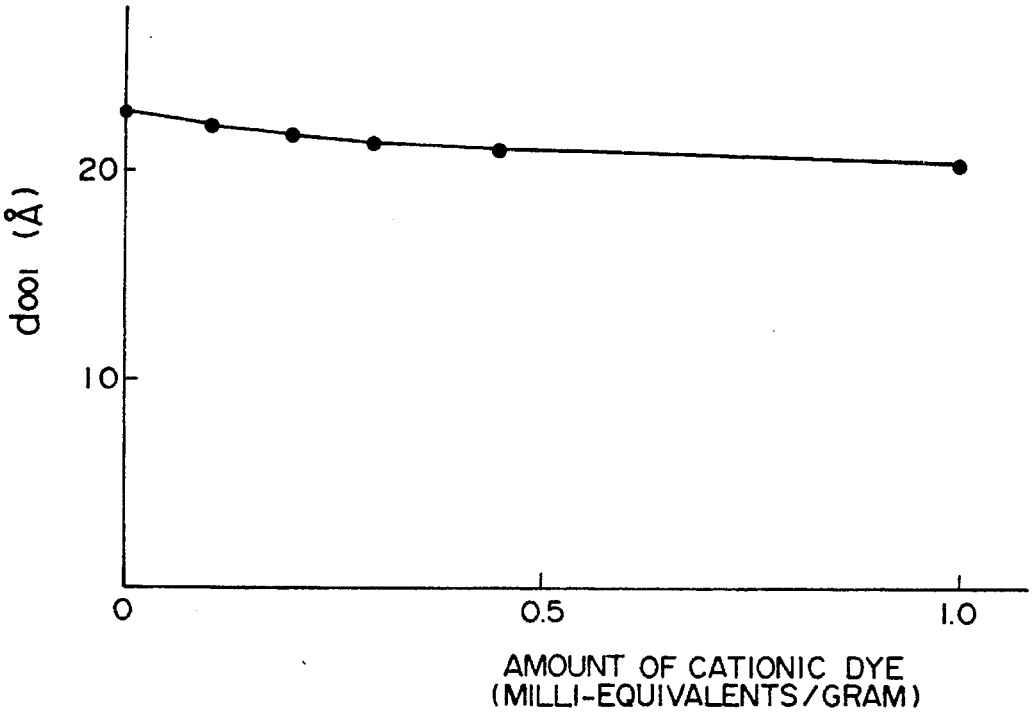
FIG. 4 is a graph illustrating the distance between the layers of montmorillonite in relation to the variation in the amount of a cationic dye.
Figure 5:
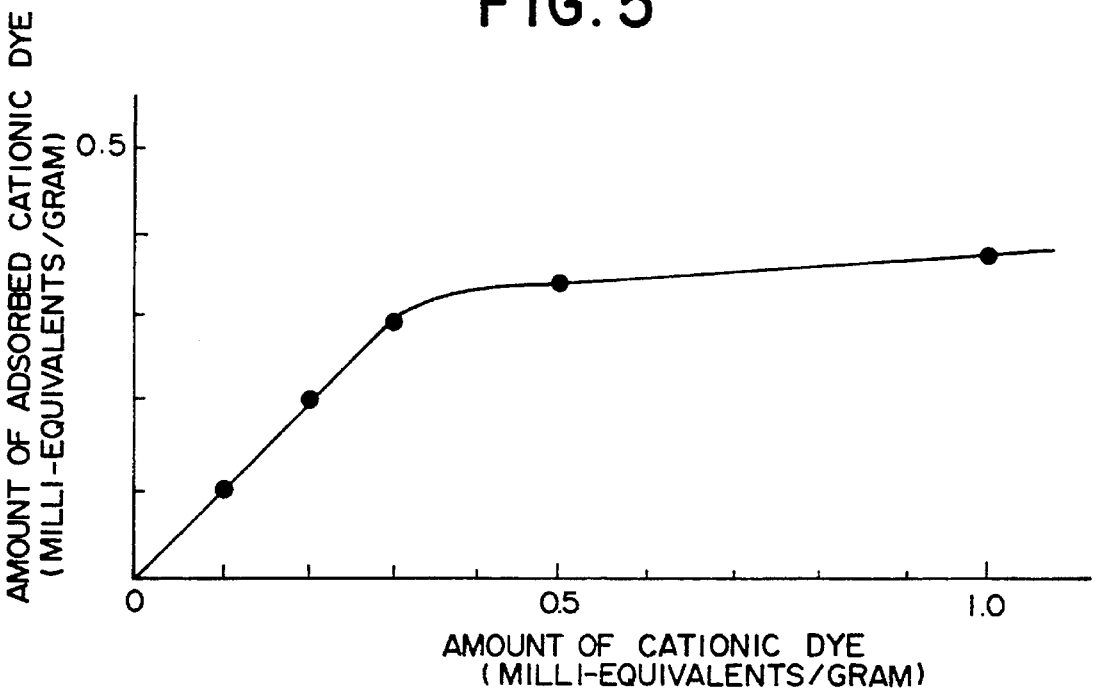
FIG. 5 is a graph illustrating the amount of an adsorbed dye in relation to the variation in the amount of a cationic dye.

The effects of supplementing the aforementioned exchange is shown in FIG. 4. FIG. 4 illustrates the relation between the concentration of the dye added in terms of the weight by mg per gram of the quaternary ammonium-substituted montmorillonite (abscissa) and the distance, dool, between the crystal layers obtained as a result of a similar fixing procedure (ordinate). In FIG. 5, variation in the amount of the adsorbed dye is shown.

Using the quaternary ammonium-substituted montmorillonite, the layer distance decreases with an increase in the amount of the dye at an initial stage as the ion exchange with the cationic dye proceeds. Likewise, the amount of the adsorbed dye increases with an increase in amount of the dye. In this respect, these decreases and increases tend to be saturated when the amounts of the dye, respectively, reach certain levels. When montmorillonite, which had not been subjected to substitution with the quaternary ammonium ions, was treated in the same manner as in A-2, a colored product with a layer distance or spacing of 16.03 angstroms was produced. However, the amount of the exchanged cationic dye was quantitatively determined, and found to be about the half of the case using the substituted montmorillonite.

A-3. Preparation of Hydrophobic Cationic Dyes 3 g of an oxazine cationic dye (AIZEN Cathilon Pure Blue 5 GH, available from Hodogaya Chem. Ind. Co., Ltd.) for dyeing acrylic fibers was dissolved in 200 cc of water, in which 100 cc of an aqueous 20 wt % dodecylbenzenesulfonate solution was dropped, thereby causing fine crystals with a metallic gloss to be settled in large amounts.

After the addition of 200 cc of chloroform to the mixed solution, the mixture was subjected to extraction by the use of a separation funnel, by which the dye was transferred to the chloroform phase. The dye, which was not ion exchanged with the anionic surface active agent, was substantially left in the aqueous phase when subjected to similar extraction. These results indicate that the aforementioned exchange treatment drastically improved the miscibility of the dye with the organic solvent.

The absorption spectra of the dye in methyl ethyl ketone exhibited little variation prior to and after the treatment.

Next, the organic phase was collected, from which the solvent was distilled off under reduced pressure. This step was followed by drying at 50° C. under reduced pressure to obtain about 4 g of a solid matter. The melting point of the solid matter, 80° C., was lower by about 40° C. than that of the starting oxazine cationic dye. Hereinafter, this solid will be referred to as a cyan hydrophobic cationic dye.

A-4. Fixing Operations in Non-Aqueous/Low Dielectric Constant Medium 0.2 g of quaternary ammonium-substituted montmorillonite was charged into 20 g of toluene (specific dielectric constant of 2.379) which had been dehydrated by means of a molecular sieve, and then subjected to ultrasonic irradiation for several minutes for swelling and dispersion.

Upon addition of 6 cc of a toluene solution of 10 mmols/liter of the cyan hydrophobic cationic dye to the dispersion, a dark bluish purple precipitate was immediately formed. The resultant supernatant liquid was substantially colorless.

The colored precipitate was collected by filtration and washed with toluene and ethanol. The dye was dissolved out only in a very small amount. The washing with a polar solvent such as ethanol was effective in removal of the unreacted dye that was not undergoing ionic bonding.

The dark bluish purple powder which was collected by this procedure had a layer distance of 16.88 angstroms.

The collected filtrate was subjected to distillation under reduced pressure to remove the solvent therefrom. Afterwards, the residue was dissolved in 500 cc of water and methanol at a mixing ratio of 1:1 on the weight basis, in which an aqueous perchlorate solution was dropped. This permitted a white precipitate to be precipitated in a large amount.

Like the example of A-2, the precipitate (collected in several tens mg) was identified as tetra-n-decylammonium perchlorate on the basis of its melting point of from 105° C. to 110° C. and IR spectrum analysis.

The results suggest that the fixing of the dye inbetween the layers of the montmorillonite through the ion exchange as in A-2 is possible in low dielectric constant mediums such as toluene. The phenomenon is based on a specific reaction between clay-based layer compounds having exchangeable cations and hydrophobic organic cations, and not on the theory of an aqueous ion exchange reaction. A similar bonding or fixing action is not expected with kaolin-based clays having no exchangeable cations, alumina and silicates such as silica gel.

A-5 Comparative Test

For comparison, the reaction of non-ion-exchangeable quaternary ammonium-substituted montmorillonite is described below.

The non-ion-exchangeable quaternary ammonium-substituted montmorillonite was prepared in the same manner as in A-1, except that n-decyltrimethylammonium bromide was used. An organic cation-clay complex having a layer distance of 14.02 angstroms was produced.

This organic cation-clay complex was mixed with a cationic dye in the same manner as described in A-2. No adsorption of the dye was recognized. More particularly, no colored precipitate was obtained, and the ethanol solvent was left colored. The light blue powder, which was collected after allowing the solution to stand overnight, had a layer distance of 14.22 angstroms with little variation being recognized.

EXAMPLE 2

B-1 Preparation of Ink Ribbon

The cyan hydrophobic cationic dye obtained in A-3 was dissolved in a mixed solvent of methyl ethyl ketone (MEK) and toluene capable of dissolving polyvinyl butyral (PVB3000K, available from Sekisui Chem. Co., Ltd.). The dye was used to prepare a coating solution of the following formulation:

| Formulation | |
|---|---|
| Polyvinyl butyral | 1 part by weight |
| Cyan hydrophobic cationic dye | 1 part by weight |
| MEK/toluene (1/1 on weight basis) | 50 parts by weight |

Figure 6:
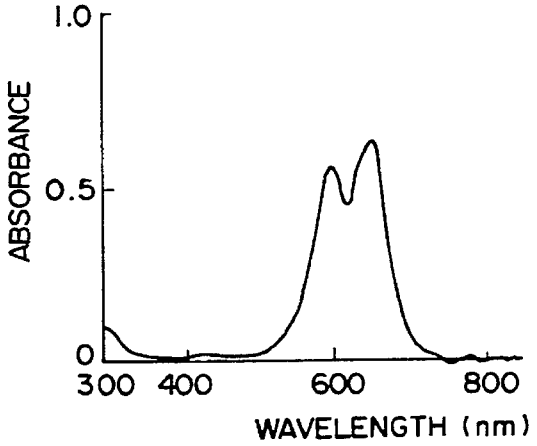
FIG. 6 is an absorption spectrum of a cyan ink ribbon.

The solution was applied onto one side of a polyethylene terephthalate film (PET film), which had a heat-resistant, lubricating layer on the other side thereof, by means of a wire bar. The solution was dried with hot air at 120° C. for 2 minutes, thereby obtaining a cyan ink ribbon having a transparent, colored layer with a dry thickness of about 1 μm. The transparent colored layer of the ink ribbon has an absorption spectra as shown in FIG. 6.

Figure 7:
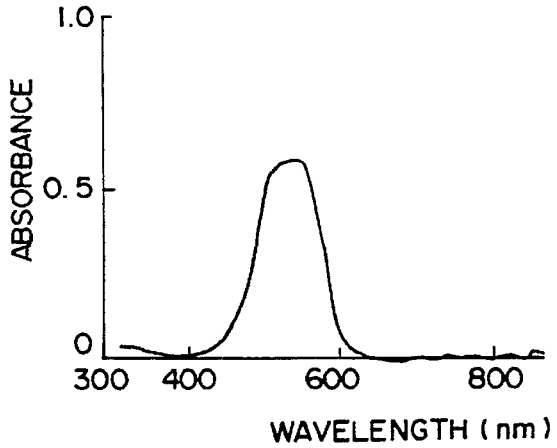
FIG. 7 is an absorption spectrum of a magenta ink ribbon.
Figure 8:
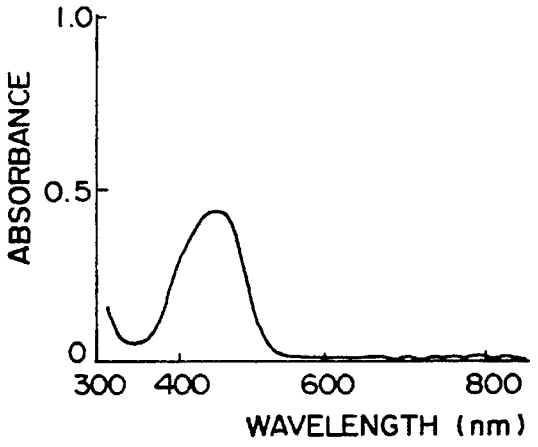
FIG. 8 is an absorption spectrum of a yellow ink ribbon.

Similarly, magenta ink ribbon and yellow ink ribbon were also prepared. For the magenta ink ribbon, a magenta cationic dye (Cathilon Brilliant Pink BH, available from Hodogaya Chem. Ind. Co., Ltd.) was used, which had been rendered hydrophobic by means of dodecylbenzenesulfonate. For the yellow ink ribbon, a yellow cationic dye (Cathilon Yellow RLH, available from Hodogaya Chem. Ind. Co., Ltd.) was used, which had been rendered hydrophobic by means of dodecylbenzenesulfonate. The absorption spectra of the transparent colored layers of the magenta ink ribbon and the yellow ink ribbon are shown in FIGS. 7 and 8, respectively.

B-2 Preparation of Printing Sheet

A solution comprising a vinylidene chloride-acrylonitrile copolymer (hereinafter referred to as PVCL-AN, available from Aldrich Inc.) at the following ratio by weight was prepared and provided as a coating stock solution 1.

| Formulation of Coating Stock Solution 1 | |
|---|---|
| PVCL-AN | 2 parts by weight |
| Silicone oil | 0.1 part by weight |
| MEK | 20 parts by weight |

The quaternary ammonium-substituted montmorillonite obtained in A-1 was ultrasonically dispersed and swollen in MEK with the following formulation and provided as a coating stock solution 2.

| Formulation of Coating Stock Solution 2 | |
|---|---|
| Tetra-n-decylammonium-substituted montmorillonite | 1 part by weight |
| MEK | 15 parts by weight |

The coating stock solutions 1 and 2 were mixed at an equal ratio by weight and subjected to ultrasonic irradiation for dispersion to provide a coating solution.

The coating solution was applied onto a 180 μm thick synthetic paper sheet by means of a doctor blade and dried at 60° C. under reduced pressure for 30 minutes.

By the aforementioned procedure, a printing sheet having an image-receiving layer with a dry thickness of about 5 μm was obtained. In order to improve surface properties, the sheet was hot pressed, so that the image-receiving layer which was glossy and light yellow in color was obtained.

The X-ray analysis revealed that the layer distance of the montmorillonite in the dye-receiving layer was 28.11 angstroms and was increased by about 5 angstroms by the dispersion treatment.

From the foregoing, it is apparent that the montmorillonite particles are swollen in the binder resin (PVCL-AN), and the hydrophobic space or region between the respective layers is filled with the binder resin. In this example, the toluene or ethanol which was used as a medium in the Simulation Test in A-4 is substituted with the binder resin.

The binder resin used in this example has a glass transition point, Tg, of 49° C., and its molecular movement is frozen at room temperature. It is assumed, however, that when an image is transferred, the layer is heated to a temperature higher than the glass transition point, Tg, thus creating a situation similar to the case under the Simulation Test.

It should be noted that the glass transition point, Tg, of a binder resin may be at a level lower than room temperature, provided that there is no problem using such a binder resin. An exception to this is the problem of blocking due to the viscosity.

B-3 Printing Test and Confirmation of a Solvent Resistance

The ink ribbon and the printing sheet obtained in B-1 and B-2, respectively, were used to form images in a practical mode.

More particularly, the cyan ink ribbon was set in a ribbon cassette of a color video printer of Sony Co., Ltd. The printing sheet was mounted on a printing sheet cassette, followed by solid printing by a single color (color developed over an entire surface). As a result, a glossy image or print with a good hue was achieved.

Part of the image was immersed at room temperature in MEK, which was a solvent used at the time of the formation of the image-receiving layer. No apparent change was observed over 15 hours.

The reflection density of the image prior to and after the immersion in the solvent was measured. Although the OD value (cyan color) was slightly reduced from 1.2 to 1.1, blurring of the image including a portion in contact with the solvent vapor was not observed.

A similar printing test was effected using the magenta ink ribbon and the yellow ink ribbon, resulting in well fixed images with good hues. Moreover, when an image was formed by superposition of three yellow, magenta and cyan colors, a good color image was obtained.

In contrast, when the above procedure was repeated, except that the printing sheet used was made using the composition of B-2 from which montmorillonite was removed, the dye was dissolved out immediately after charge in MEK, and the image disappeared within several minutes.

In addition, the above procedure was repeated except that the printing sheet used was made using the composition of B-2, and the layer compound in the composition was replaced by the n-decyltrimethyla-monium-substituted montmorillonite obtained in Comparison Test A-5. The resultant image did not disappear within a short time, but the dye gradually dissolved out immediately after the charge in the solvent. Five hours after the charge, the image at the immersed portion completely disappeared. Further, the image was blurred which was contacted with the vapor of the solvent.

EXAMPLE 3

C-1 Preparation of Printing Sheet

A dried powder of synthetic mica (DMA-350, available from Topy Ind. Co., Ltd.) having a layer distance of 12.40 angstroms was screened to collect a powder having a size of not larger than several micrometers. 20 g of the collected powder was dispersed in one liter of water and swollen, to which an equal amount of ethanol was added. While agitating, 13.2 g (20 mg equivalents) of tetra-n-decylammonium bromide was dropped in the dispersion, whereupon granular coagulation and precipitation occurred.

The dispersion was allowed to stand for one week and the resultant precipitate was removed by filtration, washed with ethanol in a large amount to remove the unreacted quaternary ammonium salt therefrom, and dried at room temperature under reduced pressure.

The ammonium-substituted synthetic mica assumed a white color with a layer distance of 29.14 angstroms.

Using the synthetic mica, a coating solution with the following formulation was prepared as in B-2 and used to form an image-receiving layer.

| Formulation of Coating Stock Solution I | |
|---|---|
| Vinyl chloride-vinyl acetate copolymer (SC550, available from Shin-Etsu Polymer Co., Ltd.) | 4 parts by weight |
| Silicone oil | 0.5 parts by weight |
| Propylene carbonate (plasticizer) | 0.5 parts by weight |
| Fluorescent brightener (UVITEXOB, available from Ciba-Geigy Co., Ltd.) | 0.01 part by weight |
| MEK | 20 parts by weight |
| **Formulation of Coating Stock Solution 2** | |
| Tetra-n-decylammonium-substituted synthetic mica | 1.5 parts by weight |
| MEK | 30 parts by weight |

Coating stock solutions 1 and 2 were mixed at equal amounts and subjected to supersonic irradiation for dispersion to obtain a coating solution. The solution was applied onto a 180 μm thick synthetic paper by the use of a doctor blade and dried at 60° C. under reduced pressure for 30 minutes.

By the above procedure, there was obtained a printing sheet having an image-receiving layer with a dry thickness of about 5 μm. In order to improve surface properties, the layer was hot pressed to produce a white, glossy printing sheet.

C-2 Printing Test

The ink ribbon obtained in B-1 was used to form images on the printing sheet in a practical mode.

More particularly, the ink ribbon was set in a ribbon cassette of a color video printer of Sony Co., Ltd. The printing sheet was set in a sheet cassette, followed by single color and stepwise printing (gradation printing) to obtain a glossy image with a high degree of gradation.

C-3 Evaluation of Migration

For evaluation of the migration, a film which was to be migrated, was formed from a coating solution of the following formulation by the use of a doctor blade in a dry thickness of 100 μm.

The resulting film had tackiness at room temperature (a measured value of the glass transition point, Tg, of −27° C.), and could adhere to but easily released.

| Formulation of Coating Solution | |
|---|---|
| Vinyl chloride resin | 1 part by weight |
| Dibutyl phthalate (plasticizer) | 1 part by weight |
| Tetrahydrofuran (solvent) | 50 parts by weight |

The self-adhesive tape was attached to the printed image and allowed to stand at room temperature for 24 hours, followed by release. A similar migration evaluation test was carried out with respect to commercially available printed images.

The residual rate of the dye was calculated from the reflection density (O.D. value) with the results shown in Table I below.

TABLE I

| (1) Initial O.D. Value | (2) O.D. Value After Migration Test | Residual Rate of Dye [(2) − Background Density]/[(1) − Background Density] × 100% |
|---|---|---|
| | Example 2: | |
| 0.26 | 0.27 | 100 |
| 0.45 | 0.45 | 100 |
| 0.86 | 0.87 | 100 |
| 1.07 | 1.07 | 100 |
| 1.20 | 1.17 | 98 |
| 1.32 | 1.25 | 95 |
| | Commercial Printing Sheet: | |
| 0.34 | 0.10 | 0 |
| 0.48 | 0.10 | 0 |
| 0.64 | 0.10 | 0 |
| 0.87 | 0.13 | 4 |
| 1.18 | 0.20 | 9 |
| 1.52 | 0.26 | 11 |

The results described hereinabove reveal that while the image on the commercial printing sheet at a light color portion migrates to the adhesive tape at 100% so that the image at the portion completely disappears, the image on the printing sheet of the present invention remains substantially fixed over an entire density region. With the printing sheet of this example, the image was not blurred or deformed when attached to the adhesive tape over a long term.

Accordingly, the thermal transfer system and method of the present invention, wherein the ink ribbon and the printing sheet using specific types of layer compounds and cationic dyes, respectively, ensure formation of images which have very good fixing properties that are comparable to silver salt photographic images.

It should be understood the various changes and modifications to the presently preferred embodiments described herein will be apparent to those in the art. Such changes and modifications can be made without departing from the spirit and scope of the present invention and without diminishing its attended advantages. It is, therefore, intended that such changes and modifications be covered by the appended claims.

We claim:

1. An image-forming method comprising the steps of:

providing a printing sheet having an image-receiving layer on one side thereof, the image-receiving layer containing at least a compound including clay minerals having a layer structure and which has ion exchangeability with a cationic dye;

providing an ink ribbon having a dye layer comprising a hydrophilic cationic dye;

contacting the ink ribbon with the image-receiving layer; and applying a thermal energy to the ink ribbon in an imagewise pattern to thermally transfer the dye from the ink ribbon to the image-receiving layer; whereby the dye is fixed through the ion exchange.

2. A thermal transfer system comprising, in combination, an ink ribbon and a printing sheet, the ink ribbon having a support and a dye layer formed on the support and comprising a hydrophilic cationic dye wherein a counter ion of the dye is substituted with an organic anion, the printing sheet having a support and an image-receiving layer formed on the support and comprising a resin binder and a compound including clay minerals having a layer structure wherein cations in the compound are substituted with organic ions capable of ion exchange with the cationic dye.

3. The thermal transfer system according to claim 2, wherein said compound is a montmorillonite of the general formula $$(X,Y)_{2-3}Z_4O_{10}(OH)_2.mH_2O.(W_{1/3})$$

wherein X=A1, Fe(III), Mn(III) or Cr(III), Y=Mg, Fe(II), Mn(II), Ni or Zn, Z=Si or A1, W=K, Na or Ca, $H_2O$ is water between the layers, and m is an integer.

4. The thermal transfer system according to claim 2, wherein the compound is a mica.

5. The thermal transfer system according to claim 2, wherein the organic ions are selected from the group consisting of quaternary alkylammonium ions, alkylphosphonium ions, and arylphosphonium ions.

6. The thermal transfer system according to claim 5, wherein said organic ions are quaternary alkylammonium ions whose alkyl moiety has a minimum of 4 carbon atoms.

7. The thermal transfer system according to claim 2, wherein said compound comprises an amount of from 5 to 90 wt % of said image-receiving layer.

8. The thermal transfer system according to claim 2, wherein said dye layer consists essentially of said hydrophobic cationic dye.

9. The thermal transfer system according to claim 2, wherein said dye layer further comprises a binder resin.

10. The thermal transfer system according to claim 2, wherein said hydrophobic cationic dye is produced by ion exchange of a cationic dye with an organic anionic surface active agent.

* * * * *